US009068733B2

(12) United States Patent
Medinis

(10) Patent No.: US 9,068,733 B2
(45) Date of Patent: Jun. 30, 2015

(54) LED LAMP WITH ACTIVELY COOLED HEAT SINK

(76) Inventor: David M. Medinis, Fort Myers, FL (US)

( * ) Notice: Subject to any disclaimer, the term of this patent is extended or adjusted under 35 U.S.C. 154(b) by 402 days.

(21) Appl. No.: 12/684,906

(22) Filed: Jan. 9, 2010

(65) Prior Publication Data

US 2011/0170287 A1 Jul. 14, 2011

(51) Int. Cl.

| | |
|---|---|
| ***F21V 5/00*** | (2006.01) |
| ***F21S 4/00*** | (2006.01) |
| ***F21V 29/02*** | (2006.01) |
| ***F21K 99/00*** | (2010.01) |
| ***F21V 29/67*** | (2015.01) |
| ***F21V 29/75*** | (2015.01) |
| ***F21V 29/76*** | (2015.01) |
| ***F21V 29/77*** | (2015.01) |
| ***F21V 29/83*** | (2015.01) |
| *F21W 131/202* | (2006.01) |
| *F21W 131/205* | (2006.01) |
| *F21Y 101/02* | (2006.01) |

(52) U.S. Cl.

CPC . *F21V 29/02* (2013.01); *F21K 9/00* (2013.01); *F21W 2131/202* (2013.01); *F21W 2131/205* (2013.01); *F21Y 2101/02* (2013.01); *F21V 29/677* (2015.01); *F21V 29/75* (2015.01); *F21V 29/76* (2015.01); *F21V 29/77* (2015.01); *F21V 29/83* (2015.01)

(58) Field of Classification Search

CPC ..... F21K 9/00; F21V 29/02; F21V 29/75; F21V 29/76; F21V 29/77; F21V 29/83; F21V 29/677; F21W 2131/202; F21W 2131/205; F21Y 2101/02

USPC ..... 362/294, 249.02, 218, 345, 373

See application file for complete search history.

(56) References Cited

U.S. PATENT DOCUMENTS

| | | | | |
|---|---|---|---|---|
| 6,955,444 | B2 | 10/2005 | Gupta | |
| 7,108,400 | B2 | 9/2006 | Yamada et al. | |
| 7,490,949 | B2 | 2/2009 | Medinis | |
| 7,575,346 | B1 * | 8/2009 | Horng et al. | 362/373 |
| 2005/0243539 | A1 | 11/2005 | Evans | |
| 2006/0262544 | A1 * | 11/2006 | Piepgras et al. | 362/373 |
| 2008/0212332 | A1 | 9/2008 | Medinis | |
| 2009/0046473 | A1 * | 2/2009 | Tsai et al. | 362/373 |

* cited by examiner

*Primary Examiner* — Thomas M Sember

(74) *Attorney, Agent, or Firm* — Arnall Golden Gregory LLP

(57) ABSTRACT

A LED lamp (1) with an actively cooled heat sink having at least one LED (7) mounted in a non-conductive substrate (8) that is attached to a heat sink (2) having a plurality of cooling vanes (9) extending therefrom. Heat generated by the at least one LED travels through the heat sink and then through the cooling vanes. Cooling channels (10) located between the cooling vanes allow for air flow between the cooling vanes. A plurality of air inlets (11) located in a housing (3) allow for air flow into the cooling channels. A fan (12) located in the housing pulls air through the air inlets through the cooling channels and across the cooling vanes through an exhaust outlet (14) where the fan then blows the air through exhaust vents (15) located on a rear of the housing.

7 Claims, 2 Drawing Sheets

LED LAMP WITH ACTIVELY COOLED HEAT SINK

BACKGROUND OF THE INVENTION

This invention relates to light emitting diode ("LED") lamps, more particularly, a light emitting diode ("LED") lamp that is compact in size and emits very little heat through the use of an actively cooled heat sink and a non-conductive substrate that acts as an insulating layer between the heat sink and LEDs mounted in the lamp.

LED lamps are commonly used in operating rooms and examination rooms by doctors, surgeons, dentists and other medical personnel to illuminate work areas. Traditional surgical lamps consist of a housing having a reflector and one or more halogen or xenon light bulbs mounted therein. However, these types of light bulbs use an excessive amount of electricity, generate a great deal of heat and do not provide a high quality light. More recent surgical lamps use LEDs in an attempt to overcome these problems. However, LEDs still generate an excessive amount of heat that can shorten the life of the LEDs, cause fatigue to medical workers and dry out exposed tissue. Such LEDs typically generate so much heat that a heat sink is required to cool the lamps. A problem with current heat sinks is that such are only passively cooled, which does not provide enough heat dissipation. Another problem with current surgical lamps having LEDs is that the LEDs are typically mounted to an aluminum substrate board which causes an excess of heat to build on the aluminum substrate board around the LEDs, thereby resulting in damage to and a shorter life span of the LEDs.

Therefore, a need exists for an actively cooled heat sink for a LED lamp that efficiently dissipates the heat created by the LEDs and a non-conductive substrate that acts as an insulating layer between the heat sink and LEDs mounted in the lamp, thereby prolonging the life of the LEDs and decreasing the amount of heat generated by the LED lamp.

The relevant prior art includes the following references:

| Pat. No. (U.S. unless stated otherwise) | Inventor | Issue/Publication Date |
|---|---|---|
| 7,490,949 | Medinis | Feb. 17, 2009 |
| 2008/021,332 | Medinis | Sep. 04, 2008 |
| 7,108,400 | Yamada et al. | Sep. 19, 2006 |
| 6,955,444 | Gupta | Oct. 18, 2005 |
| 2005/0243539 | Evans | Nov. 03, 2005 |

SUMMARY OF THE INVENTION

The primary object of the present invention is to provide a LED lamp with an actively cooled heat sink that reduces heat emitted by the LED lamp.

Another object of the present invention is to provide a LED lamp with an actively cooled heat sink that uses a non-conductive substrate for mounting the LEDs of the LED lamp into that acts as an insulating layer between the LEDs and the heat sink.

An even further object of the present invention is to provide a LED lamp with an actively cooled heat sink having a non-conductive substrate that will reduce the amount of heat emitted by the LED lamp.

Another object of the present invention is to provide a LED lamp with an actively cooled heat sink that prolongs the life of the LEDs mounted therein.

An even further object of the present invention is to provide a LED lamp that produces a high quality light for illuminating work surfaces.

The present invention fulfills the above and other objects by providing a LED lamp with an actively cooled heat sink having at least one LED mounted in a non-conductive substrate, such as Flame Retardant 4 substrate ("FR4"). The at least one LED is mounted in the non-conductive substrate so that the at least one LED makes contact with the heat sink, thereby allowing heat generated by the at least one LED to travel through the heat sink and then through a plurality of cooling vanes extending from the heat sink. The cooling vanes create additional surface area for air to come into contact with, thereby allowing more efficient cooling of the at least one LED. Cooling channels located between the cooling vanes allow for air flow between the cooling vanes.

A plurality of air inlets located on the surface of a housing allow for air to flow into the cooling channels. A fan located in a rear housing pulls air through the air inlets through the cooling channels and across the cooling vanes through an exhaust outlet where the fan blows the air through exhaust vents located in the rear housing.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
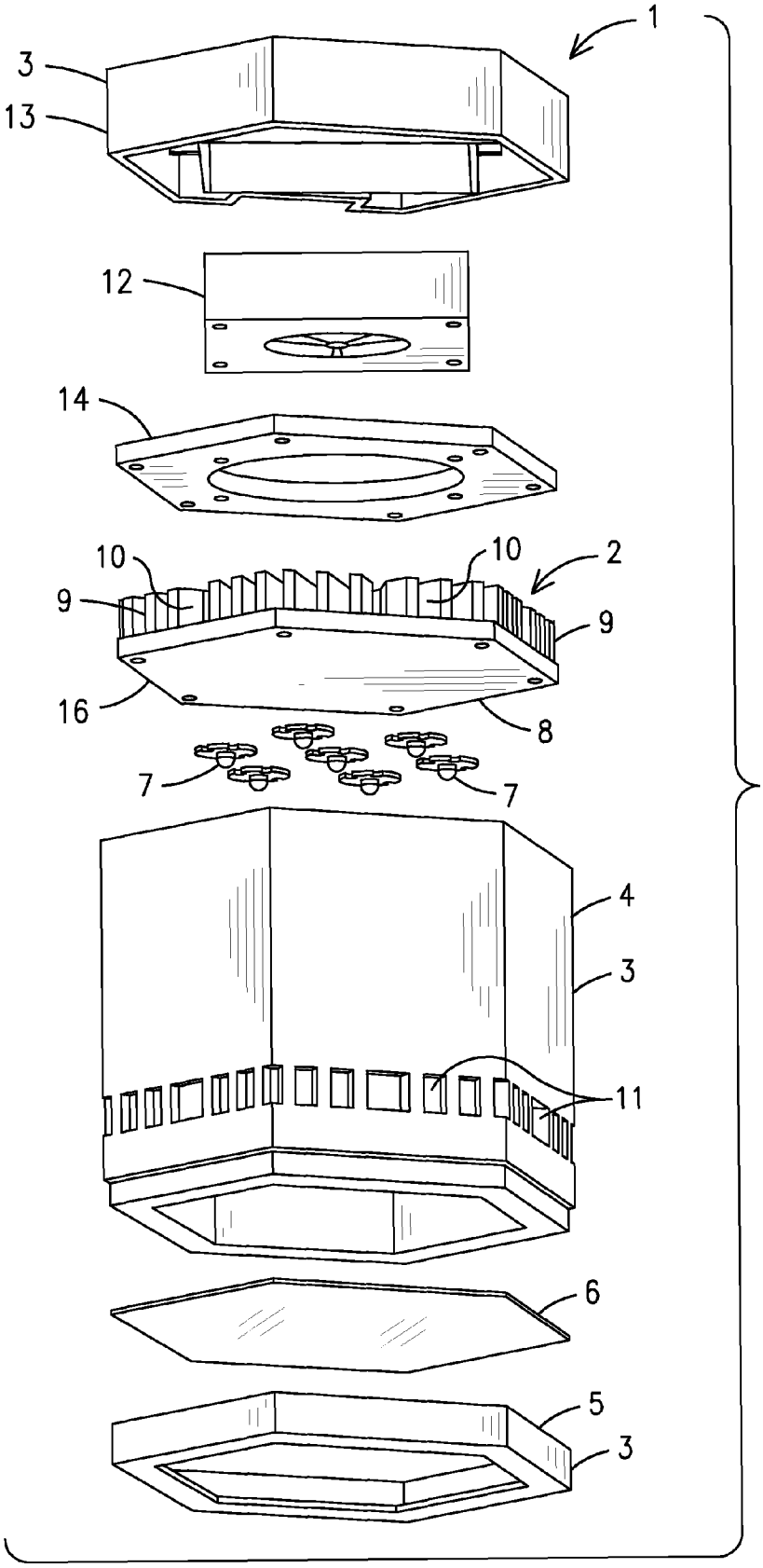
FIG. 1 is an exploded view of a LED lamp with an actively cooled heat sink of the present invention.

For purposes of describing the preferred embodiment, the terminology used in reference to the numbered accessories in the drawings is as follows:

1. LED lamp
2. heat sink
3. housing
4. main housing
5. lens housing
6. lens
7. light emitting diode ("LED")
8. non-conductive substrate
9. cooling vanes
10. cooling channels
11. air inlets
12. fan
13. rear housing
14. exhaust outlet
15. exhaust vent
16. Flame Retardant 4 substrate ("FR4")

With reference primarily to FIG. 1 and remaining drawing FIGS. as necessary, an exploded view of a LED 1 lamp with an actively cooled heat sink 2 of the present invention is shown. The LED lamp 1 and actively cooled heat sink 2 are housed in a housing 3 having a main housing 4, a lens housing 5 and a rear housing 13. The lens housing 5 houses a lens 6 on one end of the main housing 4. At least one light emitting diode ("LED") 7 is mounted in a non-conductive substrate 8, such as Flame Retardant 4 substrate ("FR4") 16. The non-conductive substrate 8 is located between the at least one LED 7 and the heat sink 2. However, the at least one LED 7 does pass through the non-conductive substrate 8 and makes contact with the heat sink, thereby allowing heat generated by the at least one LED 7 to pass to the heat sink 2. The non-conductive substrate 8 keeps the heat transferred from the at least one LED 7 from accumulating around the at least one LED 7 and/or traveling from the heat sink 2 into the lens housing 5. Heat from the at least one LED 7 travels through the heat sink 2, which has a plurality of cooling vanes 9. The cooling vanes 9 create additional surface area for air to come into contact with, thereby allowing more efficient cooling of the at least one LED 7. Cooling channels 10 located between the cooling vanes 9 allow for air flow between the cooling vanes 9.

A plurality of air inlets 11 located in the main housing 4 allow air to flow into the cooling channels 10. A fan 12 located in a rear housing 13 pulls air through the air inlets 11 through the cooling channels 10 and across the cooling vanes 9 through an exhaust outlet 14 where the fan 12 blows the air through a plurality of exhaust vents 15 located in the rear housing 13, as shown in FIG. 4.

Figure 2:
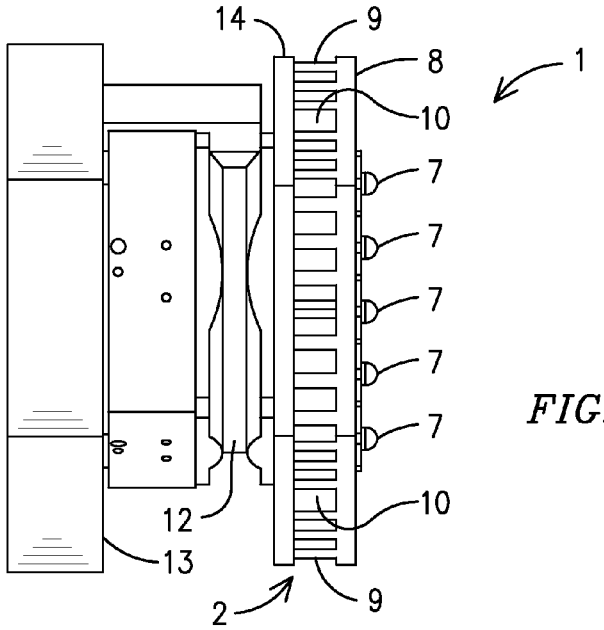
FIG. 2 is a side view of the internal components of a LED lamp with an air-cooled heat sink of the present invention.

Now referring to FIG. 2, a side view of the internal components of a LED lamp 1 with an air-cooled heat sink 2 of the present invention is shown. At least one light emitting diode ("LED") 7 is mounted in a non-conductive substrate 8. The non-conductive substrate 8 is located between the at least one LED 7 and the heat sink 2. However, the at least one LED 7 in the non-conductive substrate 8 is in contact with the heat sink 2, thereby allowing heat generated by the at least one LED 7 to transfer to the heat sink 2. Heat from the at least one LED 7 travels through the heat sink 2, which has a plurality of cooling vanes 9. The cooling vanes 9 create additional surface area, for air to come into contact with, thereby allowing more efficient cooling of the at least one LED 7. Cooling channels 10 located between the cooling vanes 9 allow for air flow between the cooling vanes 9. A fan 12 located in a rear housing 13 pulls air through the air inlets 11, through the cooling channels 10 and across the cooling vanes 9 through an exhaust outlet 14 where the fan 12 blows the air through a plurality of exhaust vents 15, as shown in FIG. 4.

Figure 3:
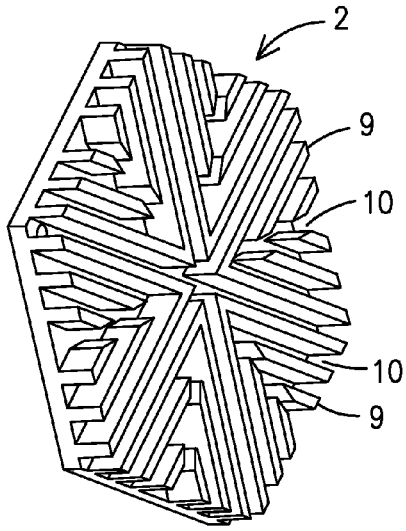
FIG. 3 is a perspective view a heat sink of the present invention having cooling vanes and cooling channels.

Now referring to FIG. 3, a perspective view of a heat sink 2 of the present invention having cooling vanes 9 and cooling channels 10 is shown. The heat sink 2 has a plurality of cooling vanes 9 to create additional surface area for air to come into contact with, thereby allowing more efficient cooling of the LED lamp 1. Cooling channels 10 located between the cooling vanes 9 allow for air flow between the cooling vanes 9. A fan 12 located in a rear housing 13, as shown in FIGS. 1 and 2, pulls air through the cooling channels 10 and across the cooling vanes 9 thereby actively cooling the heat sink 2.

Figure 4:
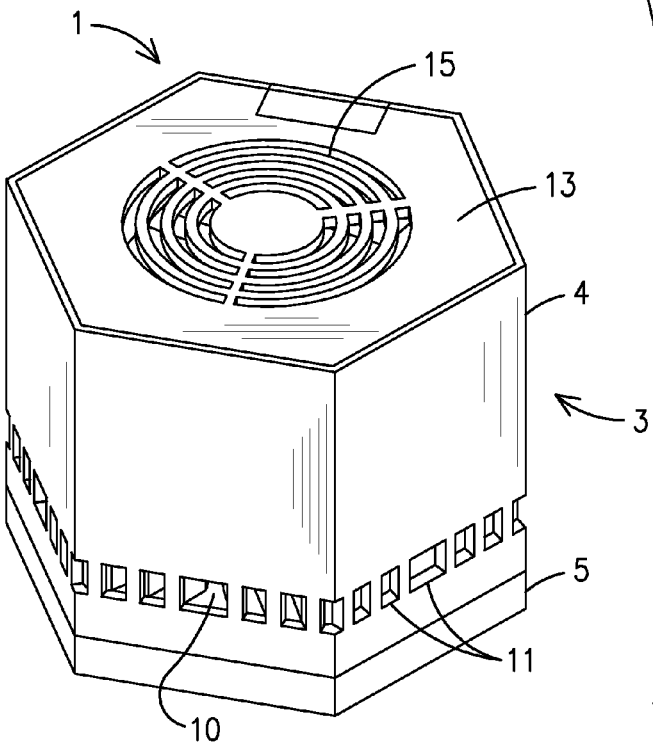
FIG. 4 is a rear perspective view of a LED lamp of the present invention.

Finally referring to FIG. 4, a rear perspective view of a LED lamp 1 of the present invention is shown. The LED lamp 1 and actively cooled heat sink 2 are housed in a housing 3 having a main housing 4 having a plurality of air inlets 11, a lens housing 5 and a rear housing 13 having a plurality of exhaust vents 15.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. An LED lamp, comprising:

a housing;

a heat sink located inside said housing;

a thermally non-conductive substrate having a first planar surface adjacent to and abutting said heat sink, said thermally non-conductive substrate having a second planar surface opposed to said first planar surface, an LED inside said housing for emitting light, said LED being located adjacent said second planar surface of said thermally non-conductive substrate and having a portion extending through said thermally non-conductive substrate and connected directly to a portion of said heat sink, wherein said portion of said LED is configured to conduct heat from said LED to said portion of said heat sink, and wherein said thermally non-conductive substrate is adapted to operate as a thermal barrier and insulate said LED from the transfer of heat toward said LED from the remainder of said heat sink;

a fan for moving air across said heat sink;

at least one air inlet defined in a surface of said housing; and at least one exhaust vent defined in a surface of said housing.

2. The LED lamp of claim 1, wherein said heat sink includes a plurality of protruding cooling vanes defining a plurality of cooling channels therebetween.

3. The LED lamp of claim 2, wherein said LED lamp further comprises an exhaust outlet panel positioned adjacent said heat sink and abutting protruding cooling vanes of said plurality of protruding cooling vanes, said exhaust outlet panel being further positioned adjacent said fan and defining an opening permitting air to flow through said cooling channels and into said fan.

4. The LED lamp of claim 3, wherein said fan is operable to cause air to flow into said housing through said at least one air inlet, through at least one of said cooling channels, and out of said housing through said at least one exhaust vent.

5. The LED lamp of claim 1, wherein said housing comprises a main housing, a lens housing and a rear housing.

6. The LED lamp of claim 5, wherein said LED lamp further comprises a lens located in said lens housing.

7. The LED lamp of claim 1 wherein, said thermally non-conductive substrate includes a Flame Retardant 4 substrate.

* * * * *